US009550364B2

(12) United States Patent
Bryant et al.

(10) Patent No.: US 9,550,364 B2
(45) Date of Patent: Jan. 24, 2017

(54) PRIMING SYSTEM FOR INKJET PRINTHEADS

(71) Applicant: FUNAI ELECTRIC CO., LTD., Daito-shi, Osaka (JP)

(72) Inventors: Justin Paul Bryant, Lexington, KY (US); Sam Norasak, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/817,036

(22) Filed: Aug. 3, 2015

(65) Prior Publication Data

US 2015/0336389 A1 Nov. 26, 2015

Related U.S. Application Data

(63) Continuation of application No. 12/982,976, filed on Dec. 31, 2010, now Pat. No. 9,096,067.

(51) Int. Cl.

| | |
|---|---|
| ***B41J 2/175*** | (2006.01) |
| ***B41J 2/21*** | (2006.01) |
| ***B41J 2/165*** | (2006.01) |
| ***B41J 2/17*** | (2006.01) |

(52) U.S. Cl.

CPC ..... *B41J 2/175* (2013.01); *B41J 2/16523* (2013.01); *B41J 2/1707* (2013.01); *B41J 2/21* (2013.01)

(58) Field of Classification Search

CPC ..... B41J 2/175; B41J 2/17513; B41J 2/17509; B41J 2/17596; B41J 2/17553; B41J 2/21; B41J 2/1707; B41J 2/16523

USPC ..... 347/85

See application file for complete search history.

(56) References Cited

U.S. PATENT DOCUMENTS

| | | | | |
|---|---|---|---|---|
| 4,553,914 | A | 11/1985 | Noell et al. | |
| 5,692,842 | A | 12/1997 | Sasai et al. | |
| 6,336,704 | B1 | 1/2002 | Shimada | |
| 6,361,138 | B1 | 3/2002 | Seino et al. | |
| 7,661,803 | B2 | 2/2010 | Morgan et al. | |
| 9,096,067 | B2 * | 8/2015 | Bryant | B41J 2/16523 |
| 2004/0075702 | A1 * | 4/2004 | Waller | B41J 2/16547 346/36 |
| 2005/0275686 | A1 | 12/2005 | Shimakawa | |
| 2006/0167336 | A1 | 7/2006 | Sayet et al. | |
| 2006/0244799 | A1 * | 11/2006 | Sasa | B41J 2/16523 347/89 |
| 2008/0024553 | A1 | 1/2008 | Morgan et al. | |
| 2009/0167800 | A1 | 7/2009 | Hatanaka et al. | |
| 2009/0214398 | A1 | 8/2009 | Hirata et al. | |

(Continued)

*Primary Examiner* — Manish S Shah
*Assistant Examiner* — Yaovi M Ameh
(74) *Attorney, Agent, or Firm* — Amster, Rothstein & Ebenstein, LLP

(57) ABSTRACT

Disclosed is a priming system for inkjet printheads that includes at least one inkjet printhead. Each inkjet printhead includes one or more single color inkjet chips. Further, the priming system includes at least one ink supply unit. Each ink supply unit is fluidly coupled to a corresponding single color inkjet chip for supplying ink to the corresponding single color inkjet chip. Furthermore, the priming system includes a pumping member that includes at least one pumping head. A pumping head is fluidly coupled to the corresponding single color inkjet chip to receive the ink from the corresponding single color inkjet chip, and to a corresponding ink supply unit to pump the ink back into the corresponding ink supply unit.

10 Claims, 6 Drawing Sheets

(56) References Cited

U.S. PATENT DOCUMENTS

2009/0266544 A1 10/2009 Redlinger et al.

* cited by examiner

PRIMING SYSTEM FOR INKJET PRINTHEADS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to inkjet printheads, and more particularly, to a priming system for inkjet printheads.

2. Description of the Related Art

A typical inkjet printhead includes a heater chip having a nozzle plate either attached to or integrated with the heater chip. The heater chip is supported on a substrate. The inkjet printhead also includes one or more ink chambers/tanks that supply ink to the heater chip and the nozzle plate for printing/priming purposes.

It has been observed that there is an increasing demand for a use of smaller ink drop sizes as well as pigmented inks for printing purposes. However, the use of the smaller ink drop sizes and the pigmented inks may be associated with problems, such as a deterioration in idle time for an inkjet printhead. The term, 'idle time,' as used herein relates to a print quality defect that is caused by evaporation of water from the nozzles of an inkjet printhead during the period of non-printing. Further, the occurrence of the idle time defect may result in droplet misdirection, erratic printing, and missing nozzles. Also, a typical inkjet printhead may have nozzles configured to eject ink in a downward direction, and accordingly, a pigmented ink is more likely to settle towards the bottom portion of the inkjet printhead or an ink tank when the inkjet printhead is sitting idle. Further, the settlement of the pigmented ink is again associated with a deterioration in idle time and other startup issues. Furthermore, the pigment loading in the ink may vary throughout the life of an inkjet printhead/tank, and the difference in pigment loading may negatively affect the consistency of optical density, thus adding to the problems associated with the settlement of the pigmented ink. The affect of idle time on print quality may be masked by frequent maintenance, such as by frequently priming/purging ink through an inkjet printhead, or by frequent nozzle spits between printed swaths.

Priming/purging is considered to be a critical maintenance step to remove trapped air bubbles, ink and any other contaminants from within the inkjet printhead, in order to facilitate the inkjet printhead to operate properly without misprinting and to achieve a high print resolution. However, it has been observed that frequent maintenance may still be unable to facilitate an inkjet printhead to perform optimally. Further, most priming systems that are known in the art may be cost-ineffective and incapable of efficiently priming an inkjet printhead. Furthermore, a large volume of ink may get wasted when being used for priming, purging, or spitting of an inkjet printhead.

Accordingly, there persists a need for an effective priming system for inkjet printheads in order to overcome the drawbacks and limitations of prior art priming systems. Specifically, there persists a need for a priming system that is cost-effective and averts any wastage of ink required to prime/purge an inkjet printhead.

SUMMARY OF THE DISCLOSURE

In view of the foregoing disadvantages inherent in the prior art, the general purpose of the present disclosure is to provide a priming system for inkjet printheads by including all the advantages of the prior art, and overcoming the drawbacks inherent therein.

The present disclosure provides a priming system for inkjet printheads. The priming system includes at least one inkjet printhead. Each inkjet printhead includes one or more single color inkjet chips. The priming system further includes at least one ink supply unit. Each ink supply unit is fluidly coupled to a corresponding single color inkjet chip. Furthermore, the priming system includes a pumping member. The pumping member includes at least one pumping head. A pumping head is fluidly coupled to the corresponding single color inkjet chip to receive the ink from the corresponding single color inkjet chip. The pumping head is further fluidly coupled to a corresponding ink supply unit to pump the ink back into the corresponding ink supply unit.

BRIEF DESCRIPTION OF THE DRAWINGS

The above-mentioned features and advantages of the present disclosure, as well as other features and advantages, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description.

The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

Figure 1:
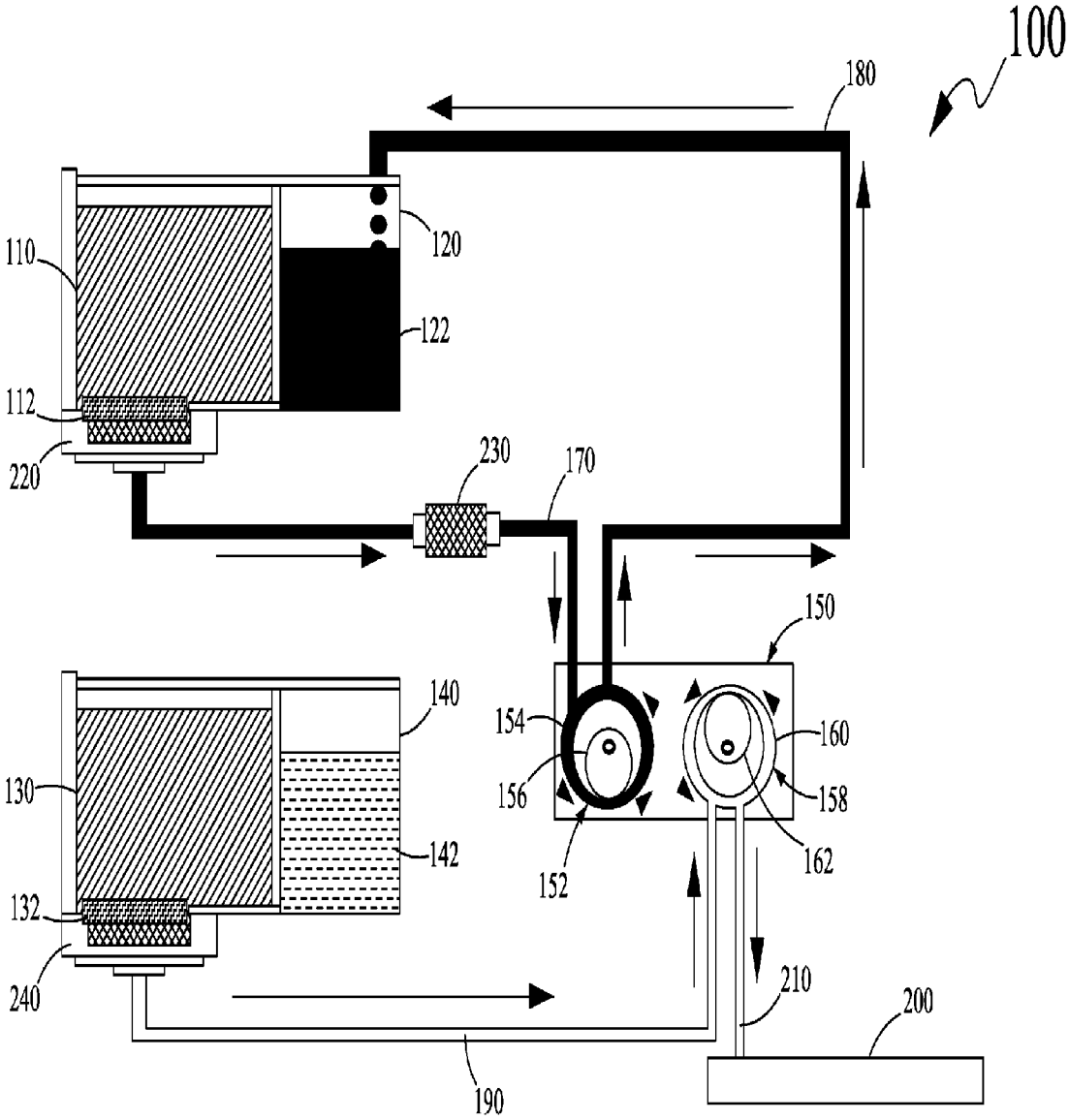
FIG. 1 illustrates a priming system for inkjet printheads, in accordance with an embodiment of the present disclosure.
Figure 2:
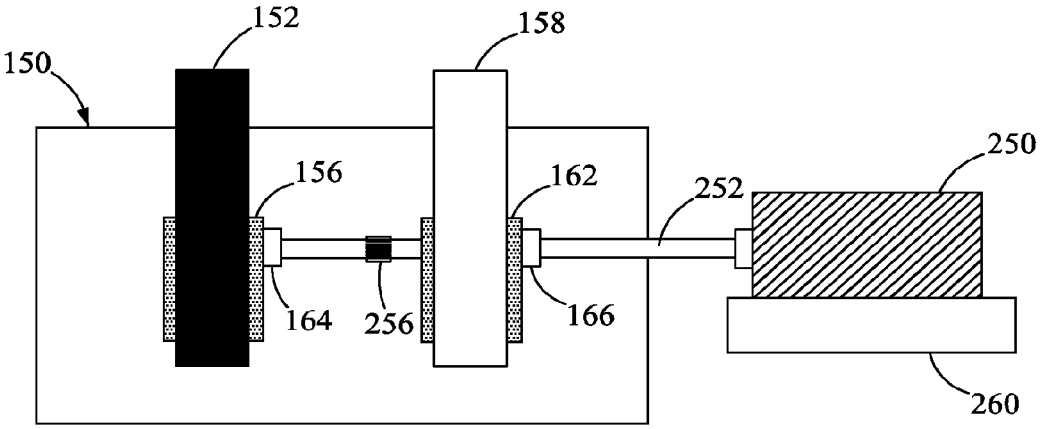
FIG. 2 illustrates an engagement of a shaft member of a motor with a first pumping head of the priming system of FIG. 1.
Figure 3:
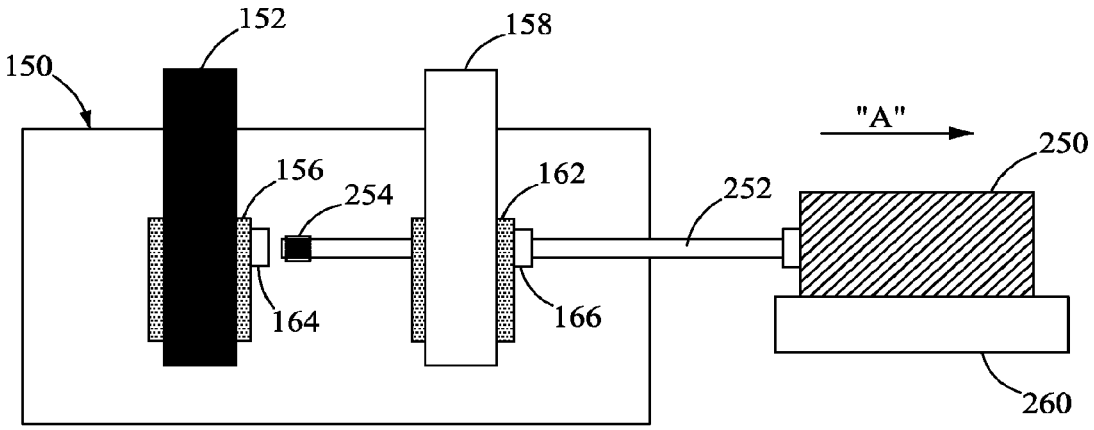
FIG. 3 illustrates an engagement of the shaft member of the motor with a second pumping head of the priming system of FIG. 1.

The present disclosure provides a priming system for inkjet printheads to remove trapped air bubbles, residual ink, and contaminants from within the inkjet printheads while also circulating the ink. The priming system includes at least one inkjet printhead. Each inkjet printhead includes one or more single color inkjet chips. The priming system further includes at least one ink supply unit. Each ink supply unit is fluidly coupled to a corresponding single color inkjet chip. Furthermore, the priming system includes a pumping member. The pumping member includes at least one pumping head. A pumping head is fluidly coupled to the corresponding single color inkjet chip to receive the ink from the corresponding single color inkjet chip. The pumping head is further fluidly coupled to a corresponding ink supply unit to pump the ink back into the corresponding ink supply unit. FIGS. 1-3 depict the priming system, in accordance with an embodiment of the present disclosure.

FIG. 1 illustrates a priming system 100 for inkjet printheads, in accordance with an embodiment of the present disclosure. The priming system 100 includes a first single color inkjet printhead 110 (hereinafter referred to as 'first inkjet printhead 110'). The first inkjet printhead 110 includes a first inkjet chip 112. The priming system 100 also includes a first ink supply unit 120 fluidly coupled to the first inkjet printhead 110, and more specifically, to the first inkjet chip 112, for supplying a first ink 122 to the first inkjet chip 112. The first inkjet chip 112 may be a mono chip (a single color inkjet chip), and the first ink supply unit 120 may be configured in the form of a reservoir on a carrier (not numbered) of the first inkjet printhead 110, as depicted in FIG. 1. Further, the first ink supply unit 120 may be configured either as a tank system or a disposable system.

The priming system 100 further includes a second inkjet printhead 130. The second inkjet printhead 130 includes a second inkjet chip 132. The priming system 100 also includes a second ink supply unit 140 fluidly coupled to the second inkjet printhead 130, and more specifically, to the second inkjet chip 132, for supplying a second ink 142 to the second inkjet chip 132. The second inkjet chip 132 may be a color chip, and more specifically, a color chip for more than one ink colors. Further, the second ink supply unit 140 may be configured in the form of a reservoir on a carrier (not numbered) of the second inkjet printhead 130, as depicted in FIG. 1. Further, the second ink supply unit 140 may be configured either as a tank system or a disposable system.

Furthermore, the priming system 100 includes a pumping member 150 that includes a first pumping head 152 fluidly coupled to the first inkjet printhead 110, and more specifically, to the first inkjet chip 112, to receive the first ink 122 from the first inkjet chip 112 via a first extracting conduit 170. Further, the first pumping head 152 is fluidly coupled to the first ink supply unit 120 to pump the first ink 122 back into the first ink supply unit 120 via a first dispensing conduit 180. The first pumping head 152 has a flexible tubing 154 configured around a rotor 156 of the first pumping head 152. The flexible tubing 154 is fluidly coupled to the first extracting conduit 170 and the first dispensing conduit 180. The rotor 156 compresses the flexible tubing 154 while rotating. A portion (not numbered) of the flexible tubing 154 closes under compression with the rotation of the rotor 156, in order to force the first ink 122 to be pumped to move through the flexible tubing 154. Additionally, the first ink 122 is induced to flow into the first pumping head 152 when the flexible tubing 154 opens to a natural state thereof.

The pumping member 150 further includes a second pumping head 158 configured adjacent to the first pumping head 152 and fluidly coupled to the second inkjet printhead 130, and more specifically, to the second inkjet chip 132 to receive the second ink 142 from the second inkjet chip 132 via a second extracting conduit 190. Although FIG. 1 is a block representation of the priming system 100 having the second pumping head 158 configured adjacent to the first pumping head 152, the second pumping head 158 may be located parallel to the first pumping head 152, as arranged in a conventional peristaltic pump that includes two pumping heads arranged in a parallel orientation with respect to each other. The second pumping head 158 has a flexible tubing 160 configured around a rotor 162 of the second pumping head 158. Specifically, the flexible tubing 160 of the second pumping head 158 is fluidly coupled to the second extracting conduit 190. The rotor 162 compresses the flexible tubing 160 while rotating. A portion (not numbered) of the flexible tubing 160 closes under compression with the rotation of the rotor 162, in order to force the second ink 142 to be pumped to move through the flexible tubing 160. Additionally, the second ink 142 is induced to flow into the second pumping head 158 when the flexible tubing 160 opens to a natural state thereof.

The second pumping head 158 is also fluidly coupled to a waste site 200 to pump the second ink 142 into the waste site 200 via a second dispensing conduit 210. Specifically, the flexible tubing 160 of the second pumping head 158 is fluidly coupled to the second dispensing conduit 210.

The pumping member 150 is a dual capacity peristaltic pump that has a first mode and a second mode of function. During the first mode, the first pumping head 152 of the pumping member 150 primes the first ink 122 from the first inkjet chip 112. Subsequently, the first ink 122 is circulated back into the first ink supply unit 120 for reuse. During, the second mode, the second pumping head 158 of the pumping member 150 primes the second ink 142 from the second inkjet chip 132 using a method that may be similar to a conventional method where primed ink is deposited in a waste site, such as the waste site 200. Such a dual mode of function is possible for inkjet printheads that have separate chips, such as a color chip (like the second inkjet chip 132) and a mono chip (like the first inkjet chip 112). Further, as depicted in FIG. 1, each of the first inkjet printhead 110 and the second inkjet printhead 130 requires independent sets of tubing, such as the first extracting conduit 170 and the first dispensing conduit 180; and the second extracting conduit 190 and the second dispensing conduit 210 to prevent cross-contamination of the first ink 122 and the second ink 142.

Moreover, the priming system 100 includes a first suction member 220 fluidly coupled to the first inkjet printhead 110. The first suction member 220 is adapted to extract the first ink 122 from the first inkjet chip 112. The priming system 100 also includes a first filtering member 230 fluidly coupled to the first suction member 220 to receive the first ink 122 from the first inkjet chip 112 through the first suction member 220. The first filtering member 230 is adapted to filter the first ink 122 sucked from the first inkjet chip 112. Further, the first filtering member 230 is adapted to be fluidly coupled to the first pumping head 152 to supply the first ink 122 to the first pumping head 152 via the first extracting conduit 170.

The priming system 100 also includes a second suction member 240 fluidly coupled to the second inkjet printhead 130 and the second pumping head 158. The second suction member 240 is adapted to extract the second ink 142 from the second inkjet chip 132 and supply the second ink 142 to the second pumping head 158 via the second extracting conduit 190.

The priming system 100 further includes a motor 250 operatively coupled to the pumping member 150 (as shown in FIGS. 2 and 3). The motor 250 includes a shaft member 252 configured to retractably engage with the first pumping head 152 (as shown in FIG. 2). Specifically, the shaft member 252 includes two points of gear engagement for each of the first and the second modes of functions of the pumping member 150. Specifically, the shaft member 252 includes a plurality of first gear teeth 254 and a plurality of second gear teeth 256 (as shown in FIGS. 2 and 3). The shaft member 252 engages with the first pumping head 152 when the shaft member 252 is received by a portion 164 of the rotor 156 of the first pumping head 152. Specifically, each gear tooth of the plurality of first gear teeth 254 of the shaft member 252 is received within/meshed with a corresponding slot (not shown) configured within the portion 164 of the rotor 156.

Alternatively, the shaft member 252 may retractably engage with the second pumping head 158 (as shown in FIG. 3). Specifically, the shaft member 252 engages with the second pumping head 158 when the shaft member 252 is received by a portion 166 of the rotor 162 of the second pumping head 158. More specifically, each gear tooth of the plurality of second gear teeth 256 of the shaft member 252 engages with a corresponding slot (not shown) configured within the portion 166 of the rotor 162.

In addition, the priming system 100 includes a solenoid 260 operatively coupled to the motor 250 in order to facilitate the retractable engagement of the shaft member 252 with the one of the first pumping head 152 and the second pumping head 158. Specifically, the solenoid 260 assists the motor 250 to extract and retract the shaft member 252 to be accommodated within the first pumping head 152 and the second pumping head 158, respectively, based on the dual mode of function of the pumping member 150.

In use, during the first mode of function of the pumping member 150, the shaft member 252 is allowed to engage with the first pumping head 152 (as shown in FIG. 2). Subsequently, the first ink 122 from the first ink supply unit 120 is pumped through the first inkjet chip 112. The first suction member 220 then sucks the first ink 122 from the first inkjet chip 112. The sucked first ink 122 is provided to the first filtering member 230 for filtering the first ink 122. Subsequently, the filtered first ink 122 is provided to the first pumping head 152 via the first extracting conduit 170. Thereafter, the first ink 122 is pumped through the first pumping head 152 and is circulated back to the first ink supply unit 120 via the first dispensing conduit 180. The circulation of the first ink 122 through the various components of the priming system 100 has been shown with the help of directional arrows (not numbered).

Further, when an electric power is provided to the motor 250 and the solenoid 260 to move the motor 250 and the solenoid 260 along a direction "A" (as shown in FIG. 3), the shaft member 252 is allowed to retract in order to engage with the second pumping head 158, during the second mode of function of the pumping member 150. Subsequently, the second ink 142 from the second ink supply unit 140 is pumped through the second inkjet chip 132. The second suction member 240 then sucks the second ink 142 from the second inkjet chip 132. The sucked second ink 142 is provided to the second pumping head 158 via the second extracting conduit 190. Thereafter, the second ink 142, which may be a cross-contaminated ink, is pumped through the second pumping head 158 and is circulated/dumped to the waste site 200 via the second dispensing conduit 210. The circulation of the second ink 142 through the various components of the priming system 100 has also been shown with the help of directional arrows (not numbered).

The priming system 100 may be considered an effective system for circulating pigmented ink for current and future inkjet printheads. The priming system 100 is cost-effective as a single motor, such as the motor 250, is shared for the first and the second modes of function of the pumping member 150. Throughout the life of the inkjet printheads that employ the priming system 100 of the present disclosure, a user/customer may often run a maintenance mode designed to "clean" respective nozzles (not shown) of the first inkjet chip 112 and the second inkjet chip 132. Further, either high frequency printing or purging may be performed using the first ink 122 and the second ink 142 during maintenance of the inkjet printheads. Accordingly, the present disclosure facilitates purging of the first ink 122, i.e., a mono ink, on a regular frequency. As the first ink 122 is circulated through the first inkjet printhead 110, the first ink 122 is filtered in order to help prevent small contaminants from re-entering the first ink supply unit 120. Also, purging the first ink 122 from the first inkjet printhead 110 has the potential to help draw air out of the first inkjet printhead 110 that may cause print related defects. Further, frequent circulation of the first ink 122, which may be a pigmented ink, through the nozzles of the first inkjet chip 112, minimizes pigment settlement issues.

In addition, the priming system 100 may help improve print quality along with reducing the amount of the first ink 122 wasted during priming and maintenance of the inkjet printhead. Specifically, estimated ink levels in the first ink supply unit 120 may improve. Accordingly, the priming system 100 provides a better gauge of ink level in the first ink supply unit 120 to provide a user/customer with a more accurate page count. Moreover, the priming system 100 may be used on other platforms where inkjet printheads have only one type of ink ejected from each of the first inkjet chip 112 and the second inkjet chip 132 (or any multiple of single color chips). For example, the priming system 100 may be applied in some of the large scale Original Equipment Manufacturers (OEM) printing systems. Also, the priming system 100 assists in circulating the first and the second inks 122, 142 between the first and the second ink supply unit 120, 140 and the main ink tanks coupled to the ink supply unit 120, 140, through ink vias (not shown) and ejectors (not shown) of the first and second inkjet printhead 110, 130 in order to accomplish cleaner nozzles and to provide an easier path for the inks to flow and eject from.

It should be understood that the priming system 100 of the present disclosure is depicted to include two inkjet printheads (i.e., the first and the second inkjet printheads 110, 130), and two corresponding ink supply units (i.e., the first and the second ink supply units 120, 140). However, the priming system 100 may include any number of inkjet printheads and ink supply units.

Figure 4:
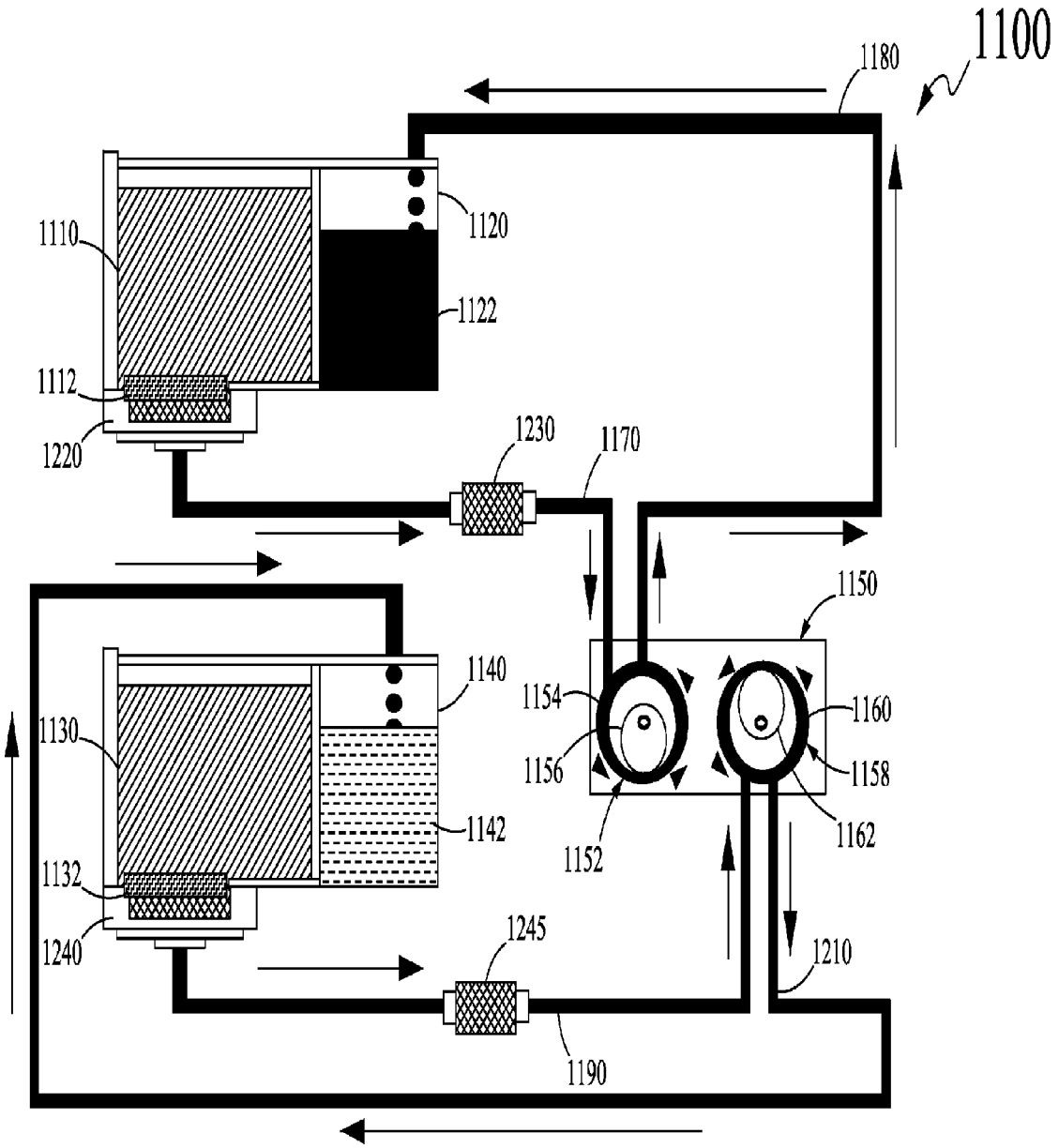
FIG. 4 illustrates a priming system for inkjet printheads, in accordance with another embodiment of the present disclosure.

FIG. 4 illustrates a priming system 1100 for inkjet printheads, in accordance with another embodiment of the present disclosure. The priming system 1100 is similar to the priming system 100 of FIG. 1, and includes a first single color inkjet printhead 1110 (hereinafter referred to as 'first inkjet printhead 1110') having a first inkjet chip 1112; a first ink supply unit 1120 fluidly coupled to the first inkjet printhead 1110, and more specifically, to the first inkjet chip 1112, for supplying a first ink 1122 to the first inkjet chip 1112; a second inkjet printhead 1130 having a second inkjet chip 1132; a second ink supply unit 1140 fluidly coupled to the second inkjet printhead 1130, and more specifically, to the second inkjet chip 1132, for supplying a second ink 1142 to the second inkjet chip 1132. The first inkjet chip 1112 and the second inkjet chip 1132 are single color inkjet chips (such as a mono chip and a magenta colored chip).

Furthermore, the priming system 1100 includes a pumping member 1150 that is similar to the pumping member 150, and includes a first pumping head 1152 fluidly coupled to the first inkjet printhead 1110, and more specifically, to the first inkjet chip 1112, to receive the first ink 1122 from the first inkjet chip 1112 via a first extracting conduit 1170. Further, the first pumping head 1152 is fluidly coupled to the first ink supply unit 1120 to pump the first ink 1122 back into the first ink supply unit 1120 via a first dispensing conduit 1180. The first pumping head 1152 has a flexible tubing 1154 configured around a rotor 1156 of the first pumping head 1152. The flexible tubing 1154 is fluidly coupled to the first extracting conduit 1170 and the first dispensing conduit 1180. The rotor 1156 compresses the flexible tubing 1154 while rotating. A portion (not numbered) of the flexible tubing 1154 closes under compression with the rotation of the rotor 1156, in order to force the first ink 1122 to be pumped to move through the flexible tubing 1154. Additionally, the first ink 1122 is induced to flow into the first pumping head 1152 when the flexible tubing 1154 opens to a natural state thereof.

The pumping member 1150 further includes a second pumping head 1158 configured adjacent to the first pumping head 1152 and fluidly coupled to the second inkjet printhead 1130, and more specifically, to the second inkjet chip 1132, to receive the second ink 1142 from the second inkjet chip 1132 via a second extracting conduit 1190. The second pumping head 1158 has a flexible tubing 1160 configured around a rotor 1162 of the second pumping head 1158. Specifically, the flexible tubing 1160 of the second pumping head 1158 is fluidly coupled to the second extracting conduit 1190. The rotor 1162 compresses the flexible tubing 1160 while rotating. A portion (not numbered) of the flexible tubing 1160 closes under compression with the rotation of the rotor 1162, in order to force the second ink 1142 to be pumped to move through the flexible tubing 1160. Additionally, the second ink 1142 is induced to flow into the second pumping head 1158 when the flexible tubing 1160 opens to a natural state thereof. The second pumping head 1158 is also fluidly coupled to the second ink supply unit 1140 to pump the second ink 1142 back into the second ink supply unit 1140 via the second dispensing conduit 1210, as the second inkjet chip 1132 is also a single color chip.

Moreover, the priming system 1100 includes a first suction member 1220 fluidly coupled to the first inkjet printhead 1110, and adapted to extract the first ink 1122 from the first inkjet chip 1112. The priming system 1100 also includes a first filtering member 1230 fluidly coupled to the first suction member 1220 to receive the first ink 1122 from the first inkjet chip 1112 through the first suction member 1220. The first filtering member 1230 is adapted to filter the first ink 1122 sucked from the first inkjet chip 1112. Further, the first filtering member 1230 is adapted to be fluidly coupled to the first pumping head 1152 to supply the first ink 1122 to the first pumping head 1152 via the first extracting conduit 1170. The priming system 1100 also includes a second suction member 1240 fluidly coupled to the second inkjet printhead 1130 and the second pumping head 1158. The second suction member 1240 is adapted to extract the second ink 1142 from the second inkjet chip 1132 and supply the second ink 1142 to the second pumping head 1158 via the second extracting conduit 1190. Additionally, the priming system 1100 includes a second filtering member 1245 fluidly coupled to the second suction member 1240, in order to receive the second ink 1142 from the second inkjet chip 1132 through the second suction member 1240. The second filtering member 1245 is adapted to filter the second ink 1142. Further, the second filtering member 1245 is adapted to be fluidly coupled to the second pumping head 1158 to supply the second ink 1142 to the second pumping head 1158 via the second extracting conduit 1190. Accordingly, the sucked second ink 1142 is provided to the second filtering member 1245 for filtering the second ink 1142. Subsequently, the filtered second ink 1142 may be provided to the second pumping head 1158 via the second extracting conduit 1190. Thereafter, the second ink 1142 may be pumped through the second pumping head 1158 and circulated back to the second ink supply unit 1140 via the second dispensing conduit 1210.

The priming system 1100 may further include a motor, similar to the motor 250, operatively coupled to the pumping member 1150 to operate the pumping member 1150; and a solenoid, similar to the solenoid 260, operatively coupled to the motor.

It should be understood that the priming system 1100 of the present disclosure is depicted to include two inkjet printheads (i.e., the first and the second inkjet printheads 1110, 1130) having the first and the second single color chips 1112, 1132, respectively. However, it will be understood that the priming system 1100 may include a single inkjet printhead (such as the first inkjet printhead 1110) having the first and the second single color chips 1112, 1132. Further, the priming system 1100 may include multiple chips, such as four or more, in case the priming system 1100 is a high volume OEM system.

Figure 5:
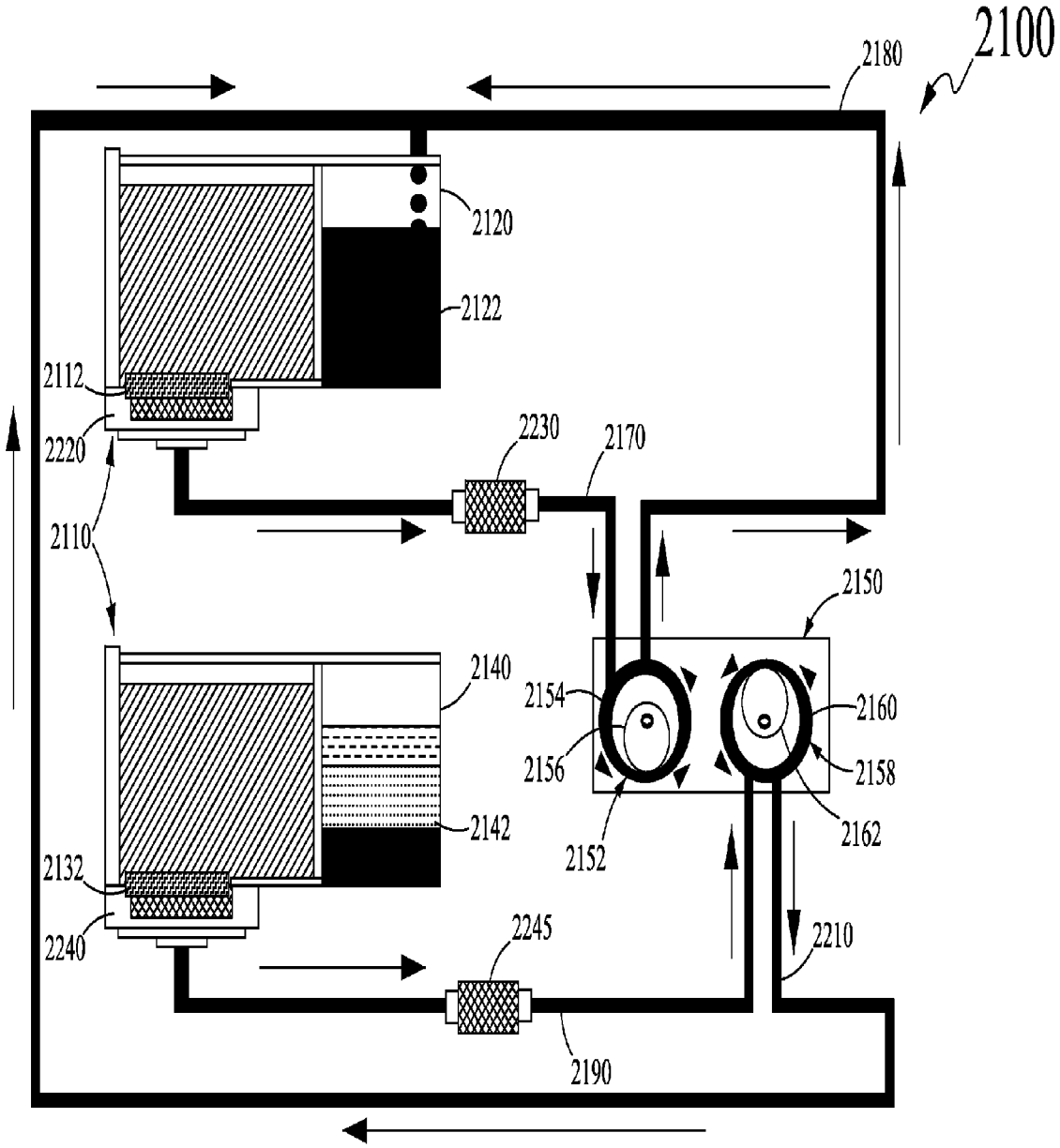
FIG. 5 illustrates a priming system for inkjet printheads, in accordance with yet another embodiment of the present disclosure.

FIG. 5 illustrates a priming system 2100 for inkjet printheads, in accordance with yet another embodiment of the present disclosure. The priming system 2100 is similar to the priming systems 100 and 1100 of FIGS. 1 and 4, and includes an inkjet printhead 2110 having a first inkjet chip 2112 and a second inkjet chip 2132; a first ink supply unit 2120 fluidly coupled to the first inkjet chip 2112, for supplying a first ink 2122 to the first inkjet chip 2112; and a second ink supply unit 2140 fluidly coupled to the second inkjet chip 2132, for supplying a second ink 2142 to the second inkjet chip 2132. The first inkjet chip 2112 is a single color mono chip and the second inkjet chip 2132 is a multi-colored chip (such as an inkjet chip for Cyan, Magenta, and Yellow (CMY) colored inks).

Furthermore, the priming system 2100 includes a pumping member 2150 that is similar to the pumping members 150 and 1150, and includes a first pumping head 2152 fluidly coupled to the inkjet printhead 2110, and more specifically, to the first inkjet chip 2112, to receive the first ink 2122 from the first inkjet chip 2112 via a first extracting conduit 2170. Further, the first pumping head 2152 is fluidly coupled to the first ink supply unit 2120 to pump the first ink 2122 back into the first ink supply unit 2120 via a first dispensing conduit 2180. The first pumping head 2152 has a flexible tubing 2154 configured around a rotor 2156 of the first pumping head 2152. The flexible tubing 2154 is fluidly coupled to the first extracting conduit 2170 and the first dispensing conduit 2180. The rotor 2156 compresses the flexible tubing 2154 while rotating. A portion (not numbered) of the flexible tubing 2154 closes under compression with the rotation of the rotor 2156, in order to force the first ink 2122 to be pumped to move through the flexible tubing 2154. Additionally, the first ink 2122 is induced to flow into the first pumping head 2152 when the flexible tubing 2154 opens to a natural state thereof.

The pumping member 2150 further includes a second pumping head 2158 configured adjacent to the first pumping head 2152 and fluidly coupled to the second inkjet chip 2132, to receive the second ink 2142 from the second inkjet chip 2132 via a second extracting conduit 2190. The second pumping head 2158 has a flexible tubing 2160 configured around a rotor 2162 of the second pumping head 2158. Specifically, the flexible tubing 2160 of the second pumping head 2158 is fluidly coupled to the second extracting conduit 2190. The rotor 2162 compresses the flexible tubing 2160 while rotating. A portion (not numbered) of the flexible tubing 2160 closes under compression with the rotation of the rotor 2162, in order to force the second ink 2142 to be pumped to move through the flexible tubing 2160. Additionally, the second ink 2142 is induced to flow into the second pumping head 2158 when the flexible tubing 2160 opens to a natural state thereof. The second pumping head 2158 is also fluidly coupled to the first ink supply unit 2120 to pump the second ink 2142 back into the first ink supply unit 2120 via a second dispensing conduit 2210.

Moreover, the priming system 2100 includes a first suction member 2220 fluidly coupled to the inkjet printhead 2110, and adapted to extract the first ink 2122 from the first inkjet chip 2112. The priming system 2100 also includes a first filtering member 2230 fluidly coupled to the first suction member 2220 to receive the first ink 2122 from the first inkjet chip 2112 through the first suction member 2220. The first filtering member 2230 is adapted to filter the first ink 2122 sucked from the first inkjet chip 2112. Further, the first filtering member 2230 is adapted to be fluidly coupled to the first pumping head 2152 to supply the first ink 2122 to the first pumping head 2152 via the first extracting conduit 2170.

The priming system 2100 also includes a second suction member 2240 fluidly coupled to the inkjet printhead 2110 and the second pumping head 2158. The second suction member 2240 is adapted to extract the second ink 2142 from the second inkjet chip 2132 and supply the second ink 2142 to the second pumping head 2158 via the second extracting conduit 2190. Additionally, the priming system 2100 includes a second filtering member 2245 fluidly coupled to the second suction member 2240, in order to receive the second ink 2142 from the first inkjet chip 2132 through the second suction member 2240. The second filtering member 2245 is adapted to filter the second ink 2142. Further, the second filtering member 2245 is adapted to be fluidly coupled to the second pumping head 2158 to supply the second ink 2142 to the second pumping head 2158 via the second extracting conduit 2190. Accordingly, the sucked second ink 2142, which is a combination of colored inks (CMY), is provided to the second filtering member 2245 for filtering the second ink 2142. Subsequently, the filtered second ink 2142 may be provided to the second pumping head 2158 via the second extracting conduit 2190. Thereafter, the second ink 2142 may be pumped through the second pumping head 2158 and circulated back to the first ink supply unit 2120 via the second dispensing conduit 2210. More specifically, when different colored inks, such as inks for Cyan, Magenta and Yellow (CMY) colors, are primed together, the colored inks may substantially turn either composite black or mono, and accordingly, the colored inks may be re-circulated/recycled to the first ink supply unit 2120 without making substantial changes in color of the first ink 2122 (mono ink).

The priming system 2100 may further include a motor, similar to the motor 250, operatively coupled to the pumping member 2150 to operate the pumping member 2150; and a solenoid, similar to the solenoid 260, operatively coupled to the motor.

Figure 6:
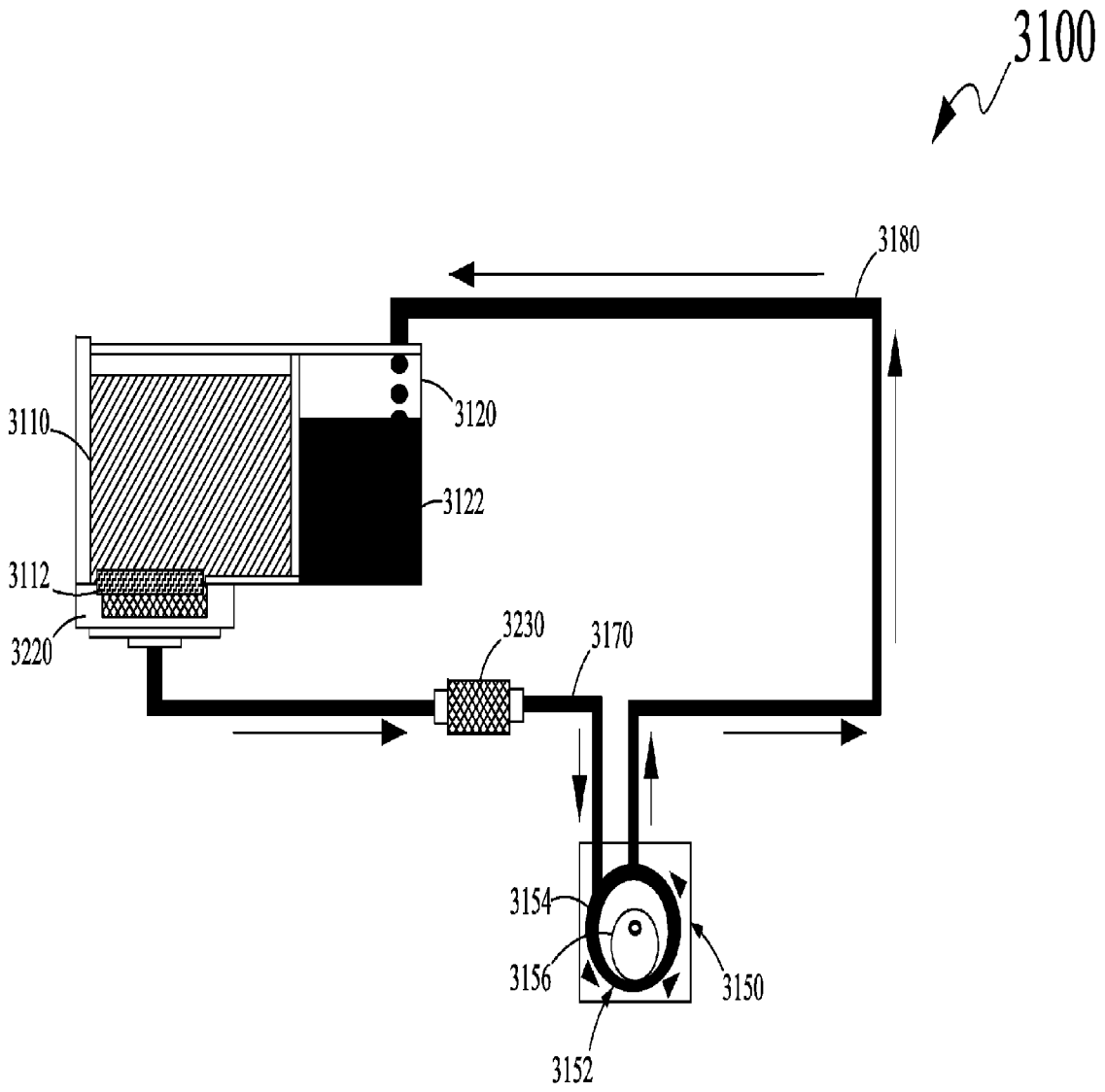
FIG. 6 illustrates a priming system for inkjet printheads, in accordance with yet another embodiment of the present disclosure.

FIG. 6 illustrates a priming system 3100 for inkjet printheads, in accordance with yet another embodiment of the present disclosure. The priming system 3100 is similar to the priming systems 100, 1100 and 2100 of FIGS. 1, 4 and 5, and includes an inkjet printhead 3110 having an inkjet chip 3112; and an ink supply unit 3120 fluidly coupled to the inkjet chip 3112, for supplying ink 3122 to the inkjet chip 3112. The inkjet chip 3112 is a single color chip, such as a mono chip. The ink supply unit 3120 may be configured as an ink receptacle adjacent to the inkjet printhead 3110 either in a tank form or a disposable form.

Furthermore, the priming system 3100 includes a pumping member 3150 that is similar to the pumping members 150, 1150, and 2150, and includes a pumping head 3152 fluidly coupled to the inkjet printhead 3110, and more specifically, to the inkjet chip 3112, to receive the ink 3122 from the inkjet chip 3112 via an extracting conduit 3170. Further, the pumping head 3152 is fluidly coupled to the ink supply unit 3120 to pump the ink 3122 back into the ink supply unit 3120 via a dispensing conduit 3180. The pumping head 3152 has a flexible tubing 3154 configured around a rotor 3156 of the pumping head 3152. The flexible tubing 3154 is fluidly coupled to the extracting conduit 3170 and the dispensing conduit 3180. The rotor 3156 compresses the flexible tubing 3154 while rotating. A portion (not numbered) of the flexible tubing 3154 closes under compression with the rotation of the rotor 3156, in order to force the ink 3122 to be pumped to move through the flexible tubing 3154. Additionally, the ink 3122 is induced to flow into the pumping head 3152 when the flexible tubing 3154 opens to a natural state thereof.

Moreover, the priming system 3100 includes a suction member 3220 fluidly coupled to the inkjet printhead 3110, and adapted to extract the ink 3122 from the inkjet chip 3112. The priming system 3100 also includes a filtering member 3230 fluidly coupled to the suction member 3220 to receive the ink 3122 from the inkjet chip 3112 through the suction member 3220. The filtering member 3230 is adapted to filter the ink 3122 sucked from the inkjet chip 3112. Further, the filtering member 3230 is adapted to be fluidly coupled to the pumping head 3152 to supply the ink 3122 to the pumping head 3152 via the extracting conduit 3170. The priming system 3100 may further include a motor, similar to the motor 250, operatively coupled to the pumping member 3150 to operate the pumping member 3150; and a solenoid, similar to the solenoid 260, operatively coupled to the motor.

Figure 7:
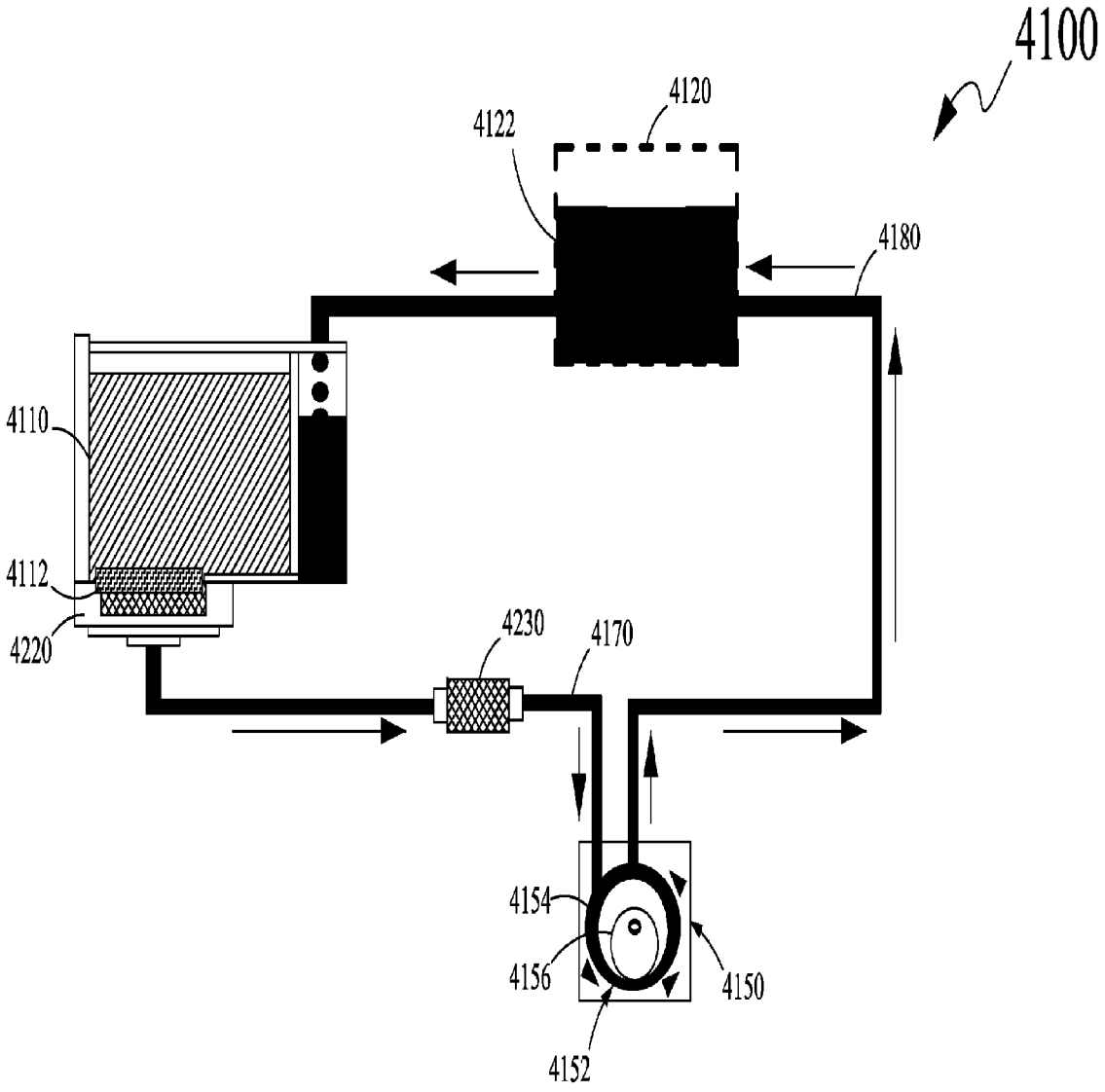
FIG. 7 illustrates a priming system for inkjet printheads, in accordance with yet another embodiment of the present disclosure.

FIG. 7 illustrates a priming system 4100 for inkjet printheads, in accordance with yet another embodiment of the present disclosure. The priming system 4100 is similar to the priming systems 100, 1100, 2100 and 3100 of FIGS. 1, 4, 5 and 6, and includes an inkjet printhead 4110 having an inkjet chip 4112; and an ink supply unit 4120 fluidly coupled to the inkjet chip 4112, for supplying ink 4122 to the inkjet chip 4112. The inkjet chip 4112 is a single color chip, such as a mono chip. The ink supply unit 4120 may be configured as an off-carrier system either in the form of a tank or a back-pressure device.

Furthermore, the priming system 4100 includes a pumping member 4150 that is similar to the pumping members 150, 1150, 2150, and 3150, and includes a pumping head 4152 fluidly coupled to the inkjet printhead 4110, and more specifically, to the inkjet chip 4112, to receive the ink 4122 from the inkjet chip 4112 via an extracting conduit 4170. Further, the pumping head 4152 is fluidly coupled to the ink supply unit 4120 to pump the ink 4122 back into the ink supply unit 4120 via a dispensing conduit 4180. The pumping head 4152 has a flexible tubing 4154 configured around a rotor 4156 of the pumping head 4152. The flexible tubing 4154 is fluidly coupled to the extracting conduit 4170 and the dispensing conduit 4180. The rotor 4156 compresses the flexible tubing 4154 while rotating. A portion (not numbered) of the flexible tubing 4154 closes under compression with the rotation of the rotor 4156, in order to force the ink 4122 to be pumped to move through the flexible tubing 4154. Additionally, the ink 4122 is induced to flow into the pumping head 4152 when the flexible tubing 4154 opens to a natural state thereof.

Moreover, the priming system 4100 includes a suction member 4220 fluidly coupled to the inkjet printhead 4110, and adapted to extract the ink 4122 from the inkjet chip 4112. The priming system 4100 also includes a filtering member 4230 fluidly coupled to the suction member 4220 to receive the ink 4122 from the inkjet chip 4112 through the suction member 4220. The filtering member 4230 is adapted to filter the ink 4122 sucked from the inkjet chip 4112. Further, the filtering member 4230 is adapted to be fluidly coupled to the pumping head 4152 to supply the ink 4122 to the pumping head 4152 via the extracting conduit 4170. The priming system 4100 may further include a motor, similar to the motor 250, operatively coupled to the pumping member 4150 to operate the pumping member 4150; and a solenoid, similar to the solenoid 260, operatively coupled to the motor.

Accordingly, the present disclosure provides a cost-effective priming system, such as the priming systems 100, 1100, 2100, 3100 and 4100, for inkjet printheads in order to overcome the drawbacks and limitations of prior art priming systems. Specifically, utilization of the priming system of the present disclosure averts any wastage of ink required to prime/purge one or more inkjet printheads.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. A method of priming one or more inkjet printheads, comprising:

extracting ink from a first single color inkjet chip of a first inkjet printhead of the one or more inkjet printheads to a first pumping head of a pumping member via a first extracting conduit disposed between the first single color inkjet chip and the first pumping head;

extracting ink from a second single color inkjet chip of the first inkjet printhead of the one or more inkjet printheads to a second pumping head of the pumping member via a second extracting conduit disposed between the second single color inkjet chip and the second pumping head, the second single color inkjet chip associated with a different ink color than the first single color inkjet chip;

pumping the ink from the first pumping head to an ink supply unit corresponding to the first single color inkjet chip of the first inkjet printhead via a first dispensing conduit such that ink flows directly from the first single color inkjet chip of the first inkjet printhead directly to the ink supply unit corresponding to the first single color inkjet chip of the first inkjet printhead; and pumping the ink from the second pumping head to an ink supply unit corresponding to the second single color inkjet chip of the first inkjet printhead via a second dispensing conduit such that ink flows directly from the second single color inkjet chip of the first inkjet printhead directly to the ink supply unit corresponding to the second single color inkjet chip of the first inkjet printhead.

2. The method of claim 1, further comprising the steps of:

extracting ink from an inkjet chip of a second inkjet printhead of the one or more inkjet printheads to a third pumping head of the pumping member via a third extracting conduit; and pumping the ink from the second pumping head to a waste site via a third dispensing conduit.

3. The method of claim 2, wherein the inkjet chip of the second inkjet printhead is a multi-color inkjet chip.

4. The method of claim 1, further comprising the steps of:

extracting ink from an inkjet chip of a second inkjet printhead of the one or more inkjet printheads to a third pumping head of the pumping member via a third extracting conduit; and pumping the ink from the second pumping head to an ink supply unit corresponding to the inkjet chip of the second inkjet printhead via a third dispensing conduit.

5. The method of claim 4, wherein the inkjet chip of the second inkjet printhead is a single color inkjet chip.

6. The method of claim 1, further comprising the steps of:

extracting ink from an inkjet chip of a second inkjet printhead of the one or more inkjet printheads to a third pumping head of the pumping member via a third extracting conduit; and pumping the ink from the second pumping head to the ink supply unit corresponding to one or more of the first single color inkjet chip and the second single color inkjet chip of the first inkjet printhead via a third dispensing conduit.

7. The method of claim 6, wherein the inkjet chip of the second inkjet printhead is a multi-color inkjet chip.

8. The method of claim 1, further comprising the step of:

retractably engaging a shaft member of a motor with the first pumping head of the pumping member.

9. The method of claim 1, wherein the step of extracting comprises sucking the ink from the inkjet chip into the first extracting conduit.

10. The method of claim 1, further comprising the step of filtering the extracted ink prior to the step of pumping.

* * * * *